United States Patent [19]

Sperry et al.

[11] 3,993,135

[45] Nov. 23, 1976

[54] THERMAL PROCESS FOR RECOVERING VISCOUS PETROLEUM

[75] Inventors: John S. Sperry; Richard W. Krajicek; Dudley P. South, Jr., all of Houston, Tex.

[73] Assignee: Carmel Energy, Inc.

[22] Filed: July 14, 1975

[21] Appl. No.: 595,340

[52] U.S. Cl. ..... 166/303; 166/57

[51] Int. Cl.[2] ..... E21B 43/24

[58] Field of Search ..... 166/303, 272, 261, 263, 166/57

[56] References Cited

UNITED STATES PATENTS

| | | | |
|---|---|---|---|
| 2,734,578 | 2/1956 | Walter | 166/272 |
| 3,136,359 | 6/1964 | Graham | 166/263 X |
| 3,259,186 | 7/1966 | Dietz | 166/263 |
| 3,583,488 | 6/1971 | Hutchison | 166/303 |

*Primary Examiner*—Stephen J. Novosad
*Attorney, Agent, or Firm*—Pravel & Wilson

[57] ABSTRACT

A thermal process for recovering heavy viscous petroleum from a subterranean hydrocarbon formation having low relative permeabilities to water and oil wherein a well bore penetrating the formation and surrounding subterranean strata are initially heated by injecting a heated fluid containing steam into the well and simultaneously venting a portion of the fluid at the surface to lift any condensed liquids forming in the well bore towards the surface to keep the well essentially free of condensed fluids. The well injection and venting are continued until the well and surrounding subterranean strata are heated sufficiently for the heated fluid to be injected into the formation without condensed liquids forming in the well at a rate greater than the formation can accept. The heated fluid is then injected directly into the formation at a high injection rate to raise the formation temperature to a desired level, followed by withdrawing the resulting heated petroleum therefrom through the well.

5 Claims, 1 Drawing Figure

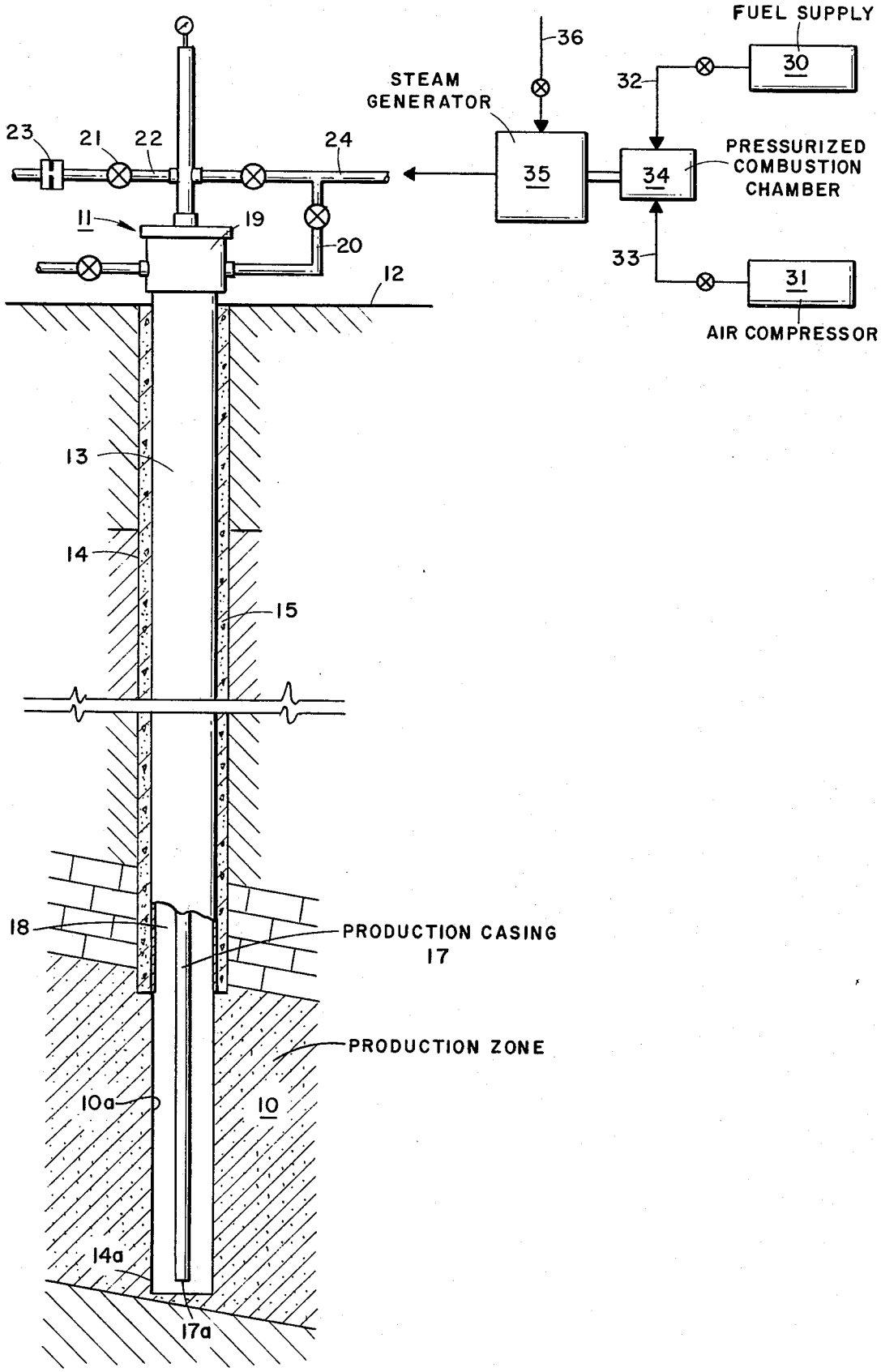
FUEL SUPPLY
30
36
32
STEAM GENERATOR
35
34
PRESSURIZED COMBUSTION CHAMBER
23
21
22
24
11
19
20
12
33
31
AIR COMPRESSOR
13
14
15
18
PRODUCTION CASING
17
PRODUCTION ZONE
10a
10
14a
17a

THERMAL PROCESS FOR RECOVERING VISCOUS PETROLEUM

BACKGROUND OF THE INVENTION

1. Field of the Invention

This invention relates to the recovery of petroleum from a subterranean formation and more particularly pertains to recovering heavy viscous petroleum from a formation having low relative permeabilities to oil and water by injecting thermal energy into the formation.

2. Description of Prior Art

There are many processes known in the art for injecting thermal energy into a formation for the purpose of reducing the viscosity of heavy viscous petroleum so that it may be recovered. Such processes are usually classified as "thermal drive," "single well thermal injection" or the like. Thermal drive processes basically involve injecting thermal energy into an oil-bearing formation by means of an injection well, driving the petroleum towards one or more adjacent producing wells and recovering the petroleum through the producing wells. Single well thermal injection processes usually involve injecting thermal energy into the oil-bearing formation by means of an injection well and subsequently withdrawing the resulting heated petroleum through the same well. Such single well thermal injection processes are also commonly referred to as "huff-and-puff" processes. There are, of course, many modified versions of these basic techniques known in the art which employ a wide variety of thermal energy agents, such as hot water, in-situ combustion steam, heated condensable and non-condensable gases, and the like.

Although many thermal injection processes have been useful under certain conditions, there are many formations known to contain large volumes of heavy viscous petroleum from which the petroleum has not been economically and efficiently recovered by the employment of any known thermal injection technique. By way of example, there are many formations located throughout the United States, particularly throughout southern Illinois, western Missouri, southeastern Oklahoma, and southern Kansas, saturated with heavy viscous crudes, e.g., having viscosities greater than 200 centipoises and/or API gravities below about 22° (both at 60° F.), which have not been recovered in economic quantities by employment of conventional "primary" recovery techniques. Additionally, previous attempts to increase the recovery of such heavy crudes from such formations by the employment of known thermal injection processes, especially direct single well steam injection, have been substantially unsuccessful. As known, one of the primary problems in attempting to recover such viscous crudes from such formations is that the formations have such low relative permeabilities to oil and water that thermal energy cannot be injected into the formations at economic injection rates. In fact, there are many formations which have such low relative permeabilities to oil and water that they will not accept sufficient quantities of thermal energy by the employment of known injection processes at any injection rate.

Accordingly, it is a primary object of the present invention to provide a process for economically and efficiently recovering heavy viscous petroleum, e.g., petroleum having a viscosity greater than 200 centipoises and/or an API gravity below about 22° (both at 60° F.) from a formation having low relative permeabilities to oil and water.

It is another object of the present invention to provide a process for heating such low relative permeability formations to permit economic recovery of such highly viscous crudes.

It is a further object of the invention to provide a process for injecting a heated fluid containing steam into a formation saturated with heavy viscous petroleum having such low relative permeabilities to water and oil that it will not accept the injection of the heated fluid containing steam at an economical injection rate by the employment of known thermal energy injection techniques.

It is yet a further object of the invention to provide a process for recovering economic quantities of such highly viscous crudes from such low permeability formations which heretofore have not been economically produced by the employment of known thermal injection processes.

SUMMARY OF THE INVENTION

Our invention is a new and improved thermal process for recovering heavy viscous petroleum from low relative permeability formations, particularly those that will not readily accept direct steam injection in sufficient quantities to allow economic petroleum recovery therefrom. The process of the invention comprises initially heating a well bore penetrating the formation and surrounding subterranean strata with a heated fluid containing steam until sufficient heat is imparted thereto to permit the heated fluid to be injected into the formation at a desired high injection rate. The well bore and surrounding strata are heated by continuously injecting the heated fluid containing steam into the well and simultaneously venting a portion of the fluid from the well at the surface to remove condensed liquids formed from the heated fluid upon contact with the well bore and formation face. The heated fluid is then injected directly into the formation at a desired high injection rate until the formation and viscous petroleum contained therein are heated to a predetermined extent. Injection is then discontinued and the heated crude is produced through the well. Surprisingly, and contrary to prior attempts, a formation having low relative permeabilities to water and oil will readily accept a heated fluid containing steam at high injection rates when the heated fluid containing steam is injected in accordance with the inventive process.

BRIEF DESCRIPTION OF THE DRAWING

The FIGURE is a schematic drawing, partially in cross-section, of a section of the earth, illustrating a well penetrating a petroleum-bearing formation and means at the surface for introducing a heated fluid containing steam into the well and formation in accordance with the process of the invention.

DETAILED DESCRIPTION OF THE INVENTION

It will be understood that the instant invention may be employed for the recovery of substantially any type viscous crude from substantially any type of subterranean formation. One of the primary advantages of the inventive process is that it provides for the injection of a heated fluid containing steam at high injection rates thereby permitting the formation to be heated to a predetermined desired level in relatively short periods of time. However, the instant process is particularly useful for recovering heavy viscous crudes, e.g., those having viscosities greater than 200 centipoise (at 60° F.) and/or API gravities (at 60° F.) of about 22° or below, from subterranean formations having low relative permeabilities to water and oil such that a heated fluid containing steam cannot be directly injected therein at an injection rate sufficiently high to impart sufficient heat to the formation and petroleum to permit the petroleum to be recovered in sufficient quantities to be economically feasible. More specifically, the instant process is useful for recovering such highly viscous crudes from a formation which has such a low relative permeability to oil and water that it will not accept the direct injection of a heated fluid containing steam at an economically high injection rate at a pressure below the formation fracture gradient pressure.

Many of such viscous crude-bearing formations having low relative permeabilities to oil and water are well-known, and are usually located within the range of from about 500 to about 2,000 ft. below the earth's surface. Included among such formations, by way of example, are those of Pennsylvanian sandstone, such as Bartlesville sandstone of the Cherokee group, which are known to be located throughout southern Illinois, western Missouri, southern Kansas and southeastern Oklahoma.

The practice of this invention can perhaps be most easily understood by reference to the drawing. As illustrated, a producing formation 10 bearing heavy viscous petroleum is penetrated by a well shown generally at 11 which has been drilled from the surface of the earth 12. The well 11 has preferably been completed in a conventional manner and includes a string of casing 13 set within a bore hole 14 to the top of the petroleum-bearing formation 10 and supported by a cement sheath 15. The bore hole 14 has penetrated the petroleum-bearing formation and has been drilled to near the bottom of the desired formation injection zone. The well bore 14 may be left open as in an open hole completion or a screen slotted liner or other perforated device (not shown) may be set in the well bore lower end **14*a* to support the walls of the well bore 14.**

The well 11 also includes a string of tubing 17 disposed within the casing 13 and the well bore 14 extending through the formation 10 thereby forming an annulus 18. Preferably, the tubing string 17 extends downwardly to near the well bore lower end **14*a*. A conventional sealing device (not shown) is provided adjacent the top of the well head 19 to seal off the annulus 18** and maintain pressure within the well.

In carrying out the process of the invention, the well bore 14 and surrounding strata through which the well 11 extends to and through the formation 10 is initially heated by injecting a heated fluid containing steam into the well annulus 18 through a valve-controlled pipe 20. The heated fluid containing steam travels down the annulus, then enters the open end **17*a* of the tubing 17, causing the heated fluid to pass upwardly through the tubing 17, whereby it is vented at the surface through a suitable venting means 23 connected with the surface end of the tubing 17, such as by pipe 22. The venting means 23 include a means for controlling the pressure in the tubing, such as a valve, restriction orifice, automatic operating valve or a combination of such devices. This pressure controlling means 23 is preferably installed between the end of the pipe 22 and a valve 21.**

If desired, the heated fluid may be injected into the tubing 17, such as through piping 24 connected therewith and vented at the surface from the annulus 18 by appropriate venting pressure controlling means mounted with pipe 20. However, we prefer annulus injection and tubing venting for heating the well 11 and surrounding strata.

The injection of the heated fluid containing steam into the well 11 causes the heated fluid to contact the tubing 17, casing 13 and the formation face **10*a* causing transfer of heat thereto. This transfer of heat causes substantially simultaneous condensation of condensable fluids, e.g., steam, in the heated fluid which may collect in the well bore 14. When the rate at which the fluid condenses in the well bore 14 is greater than the rate which the formation can accept at the injection pressure employed, the well bore 14 starts to accumulate fluids. As these fluids accumulate they reduce the area of the formation injection zone which in turn reduces the injection rate of the heated fluid into the formation. As this condition continues, the level of condensed fluids can rise to a level in the well bore 14 and formation 10** where it effectively seals off the entire formation injection horizon and the maximum injection rate of the heated fluid into the formation may drop to near zero.

However, by simultaneously venting the injected heated fluid at the surface through the pressure control means 23 in accordance with the process of the invention any condensed liquids formed and collected in the well bore 14 are forced into the well tubing 17 through its open lower end **17*a* and are forced or lifted towards the surface. The simultaneous venting step thus sweeps the condensed liquids from the well bore 14** thereby eliminating the aforementioned blockage problems.

The heated fluid containing steam is preferably continuously injected through the well 11 and simultaneously vented at the surface through the venting pressure control means 23 until the well and surrounding subterranean strata are heated sufficiently to substantially eliminate condensation of any portion of the heated fluid within the well 11 or at least reduce the amount of condensation to a level which the formation will accept without causing the aforementioned blockage problems. The length of time this requires will vary widely, depending upon well location, depth, well and surrounding strata temperatures, types of strata, etc. and is best determined emperically, such as by directly injecting the heated fluid into the formation by discontinuing venting and observing whether a desired high formation injection rate can be maintained.

The heated fluid may be injected into the well 11 at any desired rate to impart heat through the well and surrounding subterranean strata. However, we prefer to employ the maximum injection rate possible so as to impart heat as rapidly as possible. Such maximum injection rates may be obtained by employing an injection pressure above the formation pressure but below the formation fracture gradient pressure. Accordingly, we prefer to employ a maximum injection pressure practiceable below the formation fracture gradient pressure which may be readily determined if desired by known techniques. More specifically, we prefer to employ an injection pressure within the range of from about 200 to about 1500 psig.

Further, the heated fluid is vented at the surface at a rate sufficient to keep the gas velocity in the tubing 17 high enough to lift any condensed liquids formed and collected in the well bore 14 towards the surface so as to keep it substantially free of liquids while maintaining substantially full pressure on the formation. This may be readily accomplished by the employment of the aforementioned appropriate vent pressure control means at the surface, such as a valve, restriction orifice or like device in the conventional manner to provide a gas velocity in the tubing within the range of from about 10 to about 40 ft/sec.

During the above-mentioned injecting and venting the heated fluid through the well 11 the formation face 10*a* adjacent the well bore lower end is continuously exposed directly to the heated fluid, thereby gradually increasing its temperature and the temperature of the heavy viscous petroleum therein. This "preconditioning" of the adjacent formation face provides the additional benefit of cleaning the well bore 14 and formation face 10*a* of any viscous crude, paraffins, or materials which could tend to restrict flow of fluids into the petroleum-bearing formation 10.

Any type of heated fluid containing stream may be employed to heat the well 11 and surrounding subterranean strata. However, we prefer to employ a mixture of steam and a heated non-condensable gas, especially combustion gases essentially free of solid carbonaceous particles. Such a mixture of steam and combustion gases may be produced by any process known in the art. Additionally, any process and apparatus known in the art can be employed for injecting such steam-gas mixtures in accordance with the inventive process.

However, we prefer to employ a steam-gas mixture which is produced by initially combusting a hydrocarbon fuel, such as diesel oil, gasoline, heating oil, natural gas, propane, butane, crude, etc. in the presence of a stream of pressurized air under relatively high pressures, e.g., within the range of from about 200 to about 1500 psig, and contacting the resulting combustion gas pressurized stream with water. As illustrated in the drawing, this may be carried out by simultaneously injecting a hydrocarbon fuel from a suitable fuel storage supply 30 and a pressurized stream of air produced by a suitable air compressor 31 through suitable piping 32, 33, respectively, into a pressurized combustion chamber 34 specifically designed for high pressure combustion wherein the fuel is combusted under such high pressure. The injections of fuel and pressurized air stream are regulated so as to provide essentially complete combustion in the pressurized combustion chamber 34, resulting in a pressurized combustion gas stream essentially free of solid carbonaceous particles, e.g., soot. The pressurized combustion gas stream, usually having a temperature within the range of from about 2,000° to about 3,000° F., is then passed into a steam generator 35 where it is contacted with water provided through suitable piping 36 to form steam. The resulting steam-gas mixture, usually having a temperature within the range of from about 200° to about 600° F., preferably about 375° to about 525° F., can then be injected into the well annulus through piping 20 or into the well tubing through piping 24 as desired under any pressure within the range of from about 200 to about 1500 psig, depending upon the formation fracture pressure gradient. At such temperatures and pressures, the steam-gas mixture can be injected into the well 11 for heating it and the surrounding strata, described hereinabove, or directly into the formation at steam-gas injection rates within the range of from about 200,000 to about 2 million standard cubic feet per day (scfd) and heat injection rates within the range of from about 20 million to about 250 million BTU heat per day.

In accordance with the inventive process, after the well 11 and surrounding strata have been sufficiently heated, described hereinabove, venting at the surface is discontinued and the steam-gas mixture is then injected directly into the formation at the maximum injection rate possible at a pressure below the formation fracture gradient pressure. This may be accomplished by cutting off the injection of the steam-gas mixture into the well annulus 18 through the valve-controlled pipe 20, deactivating the venting pressure control means 23 by closing valve 21 and injecting the mixture into the well tubing 17 via valve controlled pipe 24. Formation injection is then continued until sufficient heated fluid has been injected to raise the formation temperature sufficiently to permit the heated petroleum to flow to the surface or to be withdrawn to the surface by the employment of conventional production means. This usually occurs with injection times ranging from a few days to several weeks, depending upon formation permeability, crude viscosity, formation fluid composition and the like, all well-known to those having ordinary skill in the art.

In carrying out the inventive process, the steam-gas mixture is continuously injected into the formation until it has been sufficiently heated at a formation injection rate averaging at least about 20 million million BTU per day heat and at least about 200,000 scfd heated fluid. In fact, we prefer to establish and maintain a formation injection rate averaging at least 50 million BTU per day heat and at least 500,000 scfd heated fluid in order to permit petroleum recovery as rapidly as practicable. However, oftentimes such injection rates are not obtained at initial formation injection and oftentimes the formation injection rate diminishes below such levels before the formation has been heated to the desired extent due to the above-mentioned formation blockage problems caused by condensed liquids forming and collecting in the well bore and adjacent injection zone of the formation. We have found that this is caused by the well and surrounding strata insufficiently heated. However, we have also found that this problem can be overcome by discontinuing direct formation injection and further heating the well 11 and surrounding strata by injecting and simultaneously venting the steam-gas mixture through the well as described above. By alternating the well heating injection and direct formation injection, the direct formation injection rate is increased and stabilized.

Therefore, any time the formation injection rate diminishes or is initially established at a rate below about 20 million BTU per day heat, preferably below about 50 million BTU per day heat, the alternate injection procedure is employed.

After the formation 10 has been heated to the desired extent, direct formation injection is discontinued at the surface and the heated, mobile petroleum is withdrawn and collected at the surface through the well 11 by the employment of conventional petroleum producing techniques, such as natural flow, pumping, and the like, all well-known in the art. If desired, the formation may be allowed to "soak" for a desired length of time prior to petroleum withdrawal to allow the steam-gas mixture to dissipate through the formation interstices, impart heat to the formation strata and petroleum and to allow the petroleum, in its heated, more mobile state, to be easily removed from the formation 10 through the well 11.

We have conducted field tests to demonstrate the usefulness of the inventive process for economic and efficient recovery of heavy viscous petroleum from a formation having low permeabilities to oil and/or water and to compare the inventive process to one comparable to a conventional direct steam injection, or huff-and-puff process. These tests were carried out on a hard sandstone formation in the Bartlesville sand, a Pennsylvanian sandstone, in the Carlysle Pool near Iola, Kansas which had a porosity of 24 percent, contained a 19° API gravity (60° F.) crude having a viscosity of 1000 cp (60° F.) with 72% oil saturation and an absolute permeability to air ranging from 400 md to 1,200 md, with an average of about 698 md. The tests were conducted in a well that had previously been drilled to depth of 910 ft. penetrating the formation with approximately 40 ft. of pay sand and completed in a conventional open hole completion manner. An adjacent well penetrating the same formation and similarly completed withdrew 0.5 to 1 barrel of crude per day, on the average, from the formation without the use of thermal stimulation.

Direct injection was attempted employing a conventional huff-and-puff technique which included injecting an admixture of steam and heated combustion gases, produced as described hereinabove through the well tubing directly into the formation. The steam-gas mixture was injected at a pressure of 640–690 psig and a temperature of 375°–420° F., measured at well head. The steam-gas mixture was initially injected into the formation at a maximum flow rate of only 63,000 standard cubic feet per day fluid. However, the injection flow rate immediately began to diminish until it reached zero after about 12 hours. The injection test did not impart sufficient heat to the formation to change the crude recovery rate to any significant extent.

After approximately 5 months the process of the invention was tested on the same well. In accordance with the present invention, the steam-gas mixture (produced as described hereinabove) was initially injected into the well annulus at a temperature of about 450° F. under a pressure of about 600 psig and simultaneously vented from the well through the well tubing and venting pressure control means at the surface which consisted of a conventional choking device or restriction orifice sized to maintain substantially full injection pressure on the formation but passing sufficient gas to keep the gas velocity in the well tubing high enough to lift condensed fluids from the well bore and formation. The well annulus injection and surface venting were continued for about 11 hours after which the steam-gas mixture was then injected directly into the formation through the well tubing at a temperature of approximately 395° F. under a pressure of approximately 610 psig which resulted in an initial maximum injection flow rate of 270,000 scfd of steam-gas mixture and 19 million BTU heat per day. After approximately 4 hours, the formation injection rate had not increased and was discontinued. Well annulus injection and surface venting were then repeated for approximately 5 hours to further increase the temperature of the well and surrounding strata. Direct formation injection was then repeated with the steam-gas mixture having a temperature of, on the average 420° F. and an average pressure of 700 psig which resulted in a maximum initial injection flow rate into the formation of about 600,000 scfd steam-gas and 42 million BTU heat per day. Formation injection was continued for 11 hours at substantially the same temperature and pressure whereby the maximum injection flow rate gradually increased to about 1,333 million scfd steam-gas and 94 million BTU heat per day. Formation injection was then halted due to a required maintenance shut-down.

After a maintenance shutdown of 2 days, the well bore was reheated by continuously injecting the steam-gas mixture through the well annulus and venting at the surface for about 5 ½ hours. Direct formation injection was then begun at an initial maximum injection flow rate of 936,000 scfd and continued for 8 days at an injection temperature ranging between 460°–480°F and pressures between 650–720 psig. During injection the maximum injection flow rate into the formation varied from 650,000 scfd to 1.05 million scfd. Direct formation injection was then stopped and the well was allowed to flow naturally. However, there was insufficient pressure in the formation to cause any substantial production of crude at the surface by natural flow. The well was then fitted with a conventional pump essentially equivalent to the pump on the above-mentioned adjacent well and the heated crude was withdrawn at a production rate of 23.3 barrels crude per day (26.6 barrels fluid per day). This represents approximately a 20 fold increase in production. The production rate leveled at 11.5 bbl/day crude and the well has continued to produce at the enhanced rate.

The results of the above tests clearly illustrate the tremendous improvement of production of heavy viscous crude from a formation having low relative permeabilities to water and oil by the employment of the process of the invention. Moreover, the tests demonstrate that the inventive process can greatly improve the production of viscous crudes as hereinbefore described from such a formation which cannot be efficiently and economically produced by the employment of a conventional direct thermal energy injection stimulation technique.

It is to be understood that the pressures and temperatures contemplated by this inventive process will vary with the specific formation to be treated, rock properties, petroleum properties, the temperature required to reduce the viscosity of the petroleum to the desired level, depth of the oil-bearing formation, etc. all of which problems are known to those skilled in the art. Further, although the inventive process is particularly useful as described, it will be readily apparent to the skilled artisan that it may also be employed in the recovery of viscous crudes from formations having higher relative permeabilities to water and/or oil and provide the advantage of increasing the temperature of such formations at faster rates than conventional direct thermal injection techniques.

Having thus described our invention, we claim:

1. A method for injecting a heated fluid containing steam into a heavy viscous petroleum-bearing subterranean formation, having low relative permeabilities to water and oil injection, at a rate sufficiently high to impart sufficient heat to the petroleum-bearing formation to permit the petroleum to be recovered at an improved rate, said method comprising:

injecting a heated fluid comprising a mixture of steam and hot combustion gas into a well penetrating the subterranean formation at a pressure above the formation pressure and below the formation fracture gradient pressure;

simultaneously venting a portion of the heated steam-combustion gas mixture from the well at the surface at a rate and pressure to maintain a gas velocity in the well sufficiently high to lift any condensed liquids forming and collecting in the well towards the surface while maintaining substantially full injection pressure on the formation, whereby the well is kept essentially free of condensed liquids;

continuing the well injection and simultaneous surface venting steps until the well, adjacent strata and a portion of the formation adjacent the well are heated sufficiently to substantially prevent condensation of liquids within the well and adjacent formation at a rate greater than that which the formation can accept at such injection pressure due to the formation low relative premeabilities to water and oil; and discontinuing the venting from the well and directly injecting the heated gas mixture into the formation under said injection pressure until sufficient heat has been imparted to the formation and petroleum to permit the petroleum to be recovered at an improved recovery rate.

2. The method of claim 1, wherein the mixture of steam and combustion gas is initially continuously injected into an annulus of the well formed by a tubing extending within a casing, both respectively extending from the surface to the formation, and a portion of the steam and combustion gas mixture is simultaneously vented at the surface through the tubing.

3. The method of claim 2, wherein the continuous initial well injection and simultaneous surface venting steps and the discontinuance of surface venting and direct formation injection steps are alternatively repeated in sequence until the mixture of steam and combustion gas can be directly injected into the formation at an injection flow rate of at least about 20 million BTU per day heat.

4. The process of claim 1, wherein the formation contains crude having an API gravity at 60° F. of less than about 22° and a viscosity of greater than 200 centipoises at 60° F.

5. The process of claim 4 wherein the formation is a Pennsylvanian sandstone.

* * * * *